US007926581B2

(12) United States Patent
Marshall et al.

(10) Patent No.: US 7,926,581 B2
(45) Date of Patent: Apr. 19, 2011

(54) WELL TOOL HAVING ENHANCED PACKING ELEMENT ASSEMBLY

(75) Inventors: Gregory S. Marshall, Magnolia, TX (US); David W. Teale, Spring, TX (US); Brett W. Bouldin, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/047,163

(22) Filed: Mar. 12, 2008

(65) Prior Publication Data

US 2008/0223588 A1 Sep. 18, 2008

(30) Foreign Application Priority Data

Mar. 12, 2007 (WO) ..... PCT/US2007/063826

(51) Int. Cl.
*E21B 33/128* (2006.01)

(52) U.S. Cl. ..... 166/387; 166/138

(58) Field of Classification Search ..... 277/337, 277/339, 340, 342, 619, 624; 166/179, 386; 251/1.1, 1.2
See application file for complete search history.

(56) References Cited

U.S. PATENT DOCUMENTS

| | | | | |
|---|---|---|---|---|
| 4,288,082 | A * | 9/1981 | Setterberg, Jr. | 277/342 |
| 4,611,658 | A * | 9/1986 | Salerni et al. | 277/337 |
| 4,852,649 | A | 8/1989 | Young | |
| 5,096,209 | A | 3/1992 | Ross | |
| 6,173,788 | B1 * | 1/2001 | Lembcke et al. | 166/387 |
| 6,565,093 | B2 * | 5/2003 | Crow et al. | 277/337 |
| 2008/0179055 | A1 * | 7/2008 | Baski | 166/147 |

FOREIGN PATENT DOCUMENTS

| | | |
|---|---|---|
| WO | WO2008111975 | 9/2008 |

OTHER PUBLICATIONS

International Search Report and Written Opinion issued for International Application No. PCT/US07/63826 dated Dec. 31, 2007 (7 pages).
Baker Packers product brochure, "Thermal Systems," Bulletin No. BTS-4-6/84, 4 pages (not dated).
Baker Oil Tools product brochure, "Retrievable Packer Systems," 3 pages (1991).
International Preliminary Report on Patentability with Written Opinion issued Sep. 24, 2009, for International Application Serial No. PCT/US07/063826, 6 pages.
Examination Report issued Aug. 20, 2010, for Australian Patent Application No. 2007349006, 2 pages.

* cited by examiner

*Primary Examiner* — David J Bagnell
*Assistant Examiner* — James G Sayre
(74) *Attorney, Agent, or Firm* — Marlin R. Smith

(57) ABSTRACT

A well tool having an enhanced performance packing element assembly. A well tool includes a packing element assembly for sealingly engaging a surface, the assembly including a packing element having at least one circumferential variation. Another well tool includes a packing element assembly including a packing element and a backup ring, the packing element being configured to bias the backup ring into contact with a surface opposite a circumferential portion of the backup ring, while another circumferential portion does not contact the surface. A method of setting a well tool includes providing a packing element assembly with multiple packing elements, and setting the well tool by squeezing fluid from between the packing elements via a gap, and then closing off the gap.

32 Claims, 6 Drawing Sheets

FIG. 1
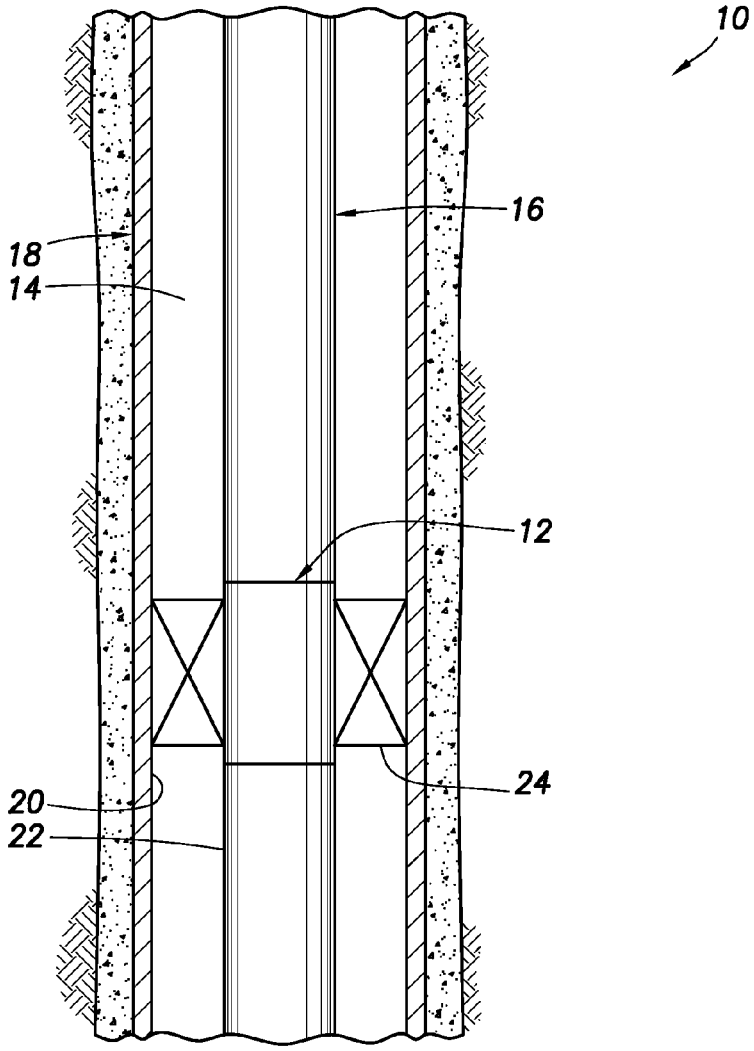
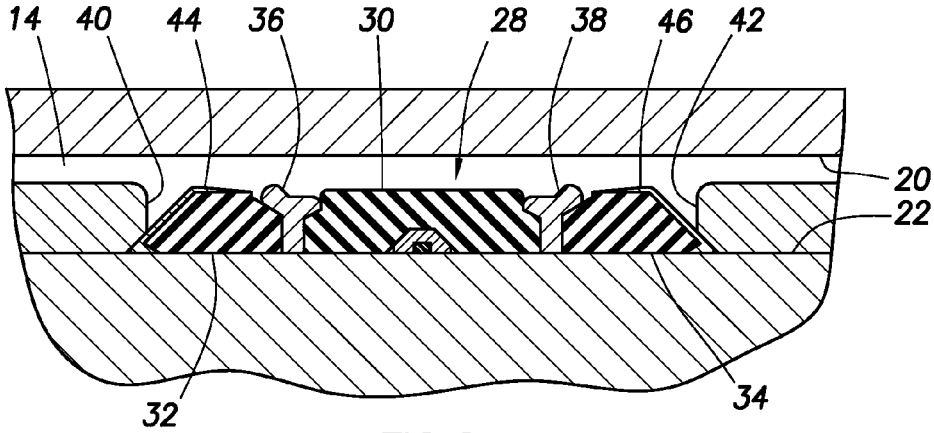
FIG. 2
(PRIOR ART)

WELL TOOL HAVING ENHANCED PACKING ELEMENT ASSEMBLY

BACKGROUND

The present invention relates generally to equipment utilized and operations performed in conjunction with a subterranean well and, in an embodiment described herein, more particularly provides a well tool having an enhanced performance packing element assembly.

Many well tools use packing element assemblies to seal off an annular space. Examples of such well tools include packers, tubing and liner hangers, etc.

Typical packing element assemblies include multiple packing elements, backup rings and other elements, such as packing element separators. Each of these structures has a useful function to perform in the overall assembly, but experience shows that well fluid can become trapped between the structures when the packing element assembly is expanded radially outward to seal off the annular space.

Attempts have been made in the past to alleviate this problem of trapped fluid in packing element assemblies. One proposed solution is to increase the setting force used to expand the assembly. However, increased setting force requires larger setting pistons, application of increased pressure and/or components having increased strength, etc. Each of these presents its own set of problems to overcome.

Another proposed solution is to increase the time period during which the packing element assembly is expanded. In this manner, more time is allowed for the fluid to escape from the packing element assembly. However, increasing the setting time requires pressure to be applied for a longer period and/or increases the cost of the setting operation, etc.

Yet another proposed solution is to provide fluid escape routes in the form of holes or slots in the backup rings. However, this leads to undesirable stress concentrations in the backup rings and/or allows excess extrusion of packing elements through the holes or slots, etc.

Therefore, it may be seen that improvements are needed in the art of packing element assembly construction.

SUMMARY

In carrying out the principles of the present invention, a packing element assembly is provided which solves at least one problem in the art. One example is described below in which a packing element of the assembly is provided with a shape which biases a backup ring to expand non-uniformly, thereby allowing fluid to escape from the assembly. Another example is described below in which a packing element of the assembly has a cross-section and/or material properties which vary about a circumference of the packing element.

In one aspect, a well tool is provided which includes a packing element assembly for sealingly engaging a surface. The assembly includes a packing element having at least one circumferential variation.

In another aspect, a well tool is provided which includes a packing element assembly with a packing element and a backup ring. The packing element is configured to bias the backup ring into contact with a surface opposite a circumferential portion of the backup ring, while another circumferential portion of the backup ring does not contact the surface.

In yet another aspect, a method of setting a well tool including a packing element assembly is provided. The method includes the steps of: providing the packing element assembly with a packing element having at least one circumferential variation; and setting the well tool. In the setting step, the packing element applies a biasing force to displace a portion of the packing element assembly into contact with a surface, and the biasing force is different at the variation as compared to at portions of the packing element circumferentially spaced apart from the variation.

In a further aspect, a method of setting a well tool including a packing element assembly includes the steps of: providing the packing element assembly with multiple packing elements; and setting the well tool, the setting step including squeezing fluid from between the packing elements via at least one gap, and then closing off the gap.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

BRIEF DESCRIPTION OF THE DRAWINGS

FIG. 1 is a schematic view of a well system embodying principles of the present invention;

FIG. 2 is an enlarged scale schematic cross-sectional view of a prior art packing element assembly;

DETAILED DESCRIPTION

Figure 3B:
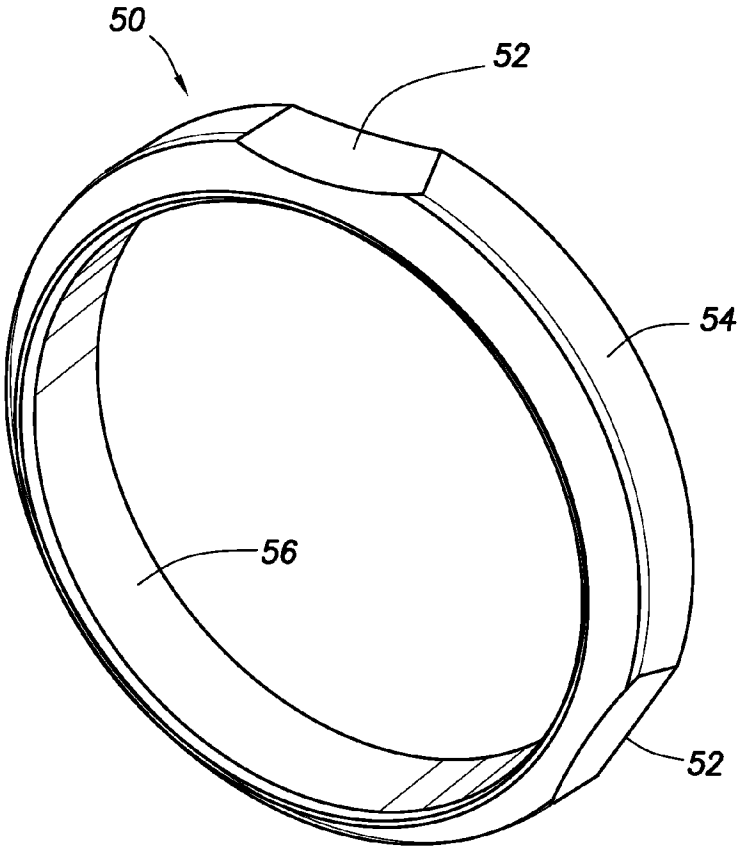
FIGS. 3A & B are schematic isometric views of a packing element embodying principles of the present invention.

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments. In the following description of the representative embodiments of the invention, directional terms, such as "above", "below", "upper", "lower", etc., are used merely for convenience in referring to the accompanying drawings.

Representatively illustrated in FIG. 1 is a well system 10 which embodies principles of the present invention. In the system 10, a well tool 12 is used to seal off an annular space 14 between an inner tubular string 16 and an outer tubular string 18. More specifically, the well tool 12 provides a pressure barrier between an inner surface 20 of the tubular string 18 and an outer surface 22 of the tubular string 16.

As depicted in FIG. 1, the inner tubular string 16 could be a production tubing string, coiled tubing string, liner string, or another type of tubular string. The outer tubular string 18 could be a casing string, liner string, tubing string, or another type of tubular string.

Note that it is not necessary in keeping with the principles of the invention for the well tool 12 to be used for sealing between tubular strings 16, 18. For example, the outer tubular string 18 could instead be a wellhead or other structure, in which case the surface 20 would be an inner surface of the structure. Similarly, the inner tubular string 16 could also be another type of structure, if desired, in which case the surface 22 would be an outer surface of the structure.

The well tool 12 could be a packer, liner hanger, tubing hanger, or another type of well tool. As illustrated in FIG. 1, the well tool 12 includes a packing element assembly 24 which seals off the annular space 14 between the surfaces 20, 22. Preferably, the assembly 24 includes features described more fully below which enhance the ability of the assembly to successfully seal off the annular space 14.

In the system 10, the well tool 12 is conveyed with the inner tubular string 16 into the outer tubular string 18 and then, when properly positioned, the well tool is "set" to thereby cause the assembly 24 to seal off the annular space 14. The well tool 12 could also include anchoring devices, such as slips, etc., which function to secure the well tool in position relative to the outer tubular string 18.

As used herein, the term "setting" and similar terms (such as "set") indicate the operation which causes the sealing off of a space (such as the space 14) between surfaces (such as the surfaces 20, 22). The setting operation may be performed in various ways, for example, by applying pressure to the interior of the inner tubular string 16, applying force to the tubular string, manipulating the tubular string, etc. Any method of setting the well tool 12 may be used in keeping with the principles of the invention.

Typically, the setting operation will result in the packing element assembly 24 being expanded radially outward into sealing contact with the surface 20. This outward expansion could be caused by longitudinal compression of the assembly 24, but any other method of expanding the assembly may be used in keeping with the principles of the invention. For example, the assembly 24 could be expanded by inflation, swelling, etc.

Note that the well tool 12 could be carried on the outer tubular string 18, instead of on the inner tubular string 16, in which case the setting operation could result in the assembly 24 being expanded radially inward to seal off the annular space 14. Thus, it should be clearly understood that the principles of the invention are not limited at all by the details of the well system 10 depicted in FIG. 1 and described herein.

Referring additionally now to FIG. 2, a prior art packing element assembly 28 is schematically illustrated, so that certain advantages provided by the present invention may be more fully appreciated. In the past, this type of packing element assembly 28 would have been used to seal off the annular space 14 between the surfaces 20, 22.

The assembly 28 includes a central packing element 30 straddled by outer packing elements 32, 34. Separators 36, 38 help to maintain the shapes of the packing elements 30, 32, 34 when they are longitudinally compressed between shoulders 40, 42. One or both of the shoulders 40, 42 may be displaced inward toward the assembly 28 to longitudinally compress the assembly.

As the assembly 28 is longitudinally compressed, the packing elements 30, 32, 34 expand radially outward. One result of this outward expansion is that the outer packing elements 32, 34 bias backup rings 44, 46 to deform radially outward and eventually contact the surface 20, thereby restricting extrusion of the elements 30, 32, 34 past the backup rings.

It will be appreciated that, since voids exist between the elements 30, 32, 34, the separators 36, 38, the backup rings 44, 46 and any other structures of the assembly 28, it is quite possible that fluid will become trapped in the assembly 28 as it expands radially outward into sealing contact with the surface 20. In particular, the outer elements 32, 34, with support from the backup rings 44, 46, operate to seal off the annular space 14 at opposite ends of the assembly 28 before the setting operation is concluded, due in part to the fact that the outer elements and backup rings are circumferentially continuous and uniform in cross-section.

As mentioned above, the backup rings 44, 46 have been provided with holes and slots (not shown in FIG. 2) in the past to allow fluid to escape from the assembly 28 during the setting operation. Holes and/or slots may also have been provided in the shoulders 40, 42. Unfortunately, these holes and slots allow undesirable extrusion of the elements 30, 32, 34, cause undesirable stress concentrations in the backup rings 44, 46, etc.

Radially or longitudinally oriented holes have also been formed in seal elements to vent fluid from the interior (inner diameter) to the exterior (outer diameter) of a packing element assembly.

Figure 3A:
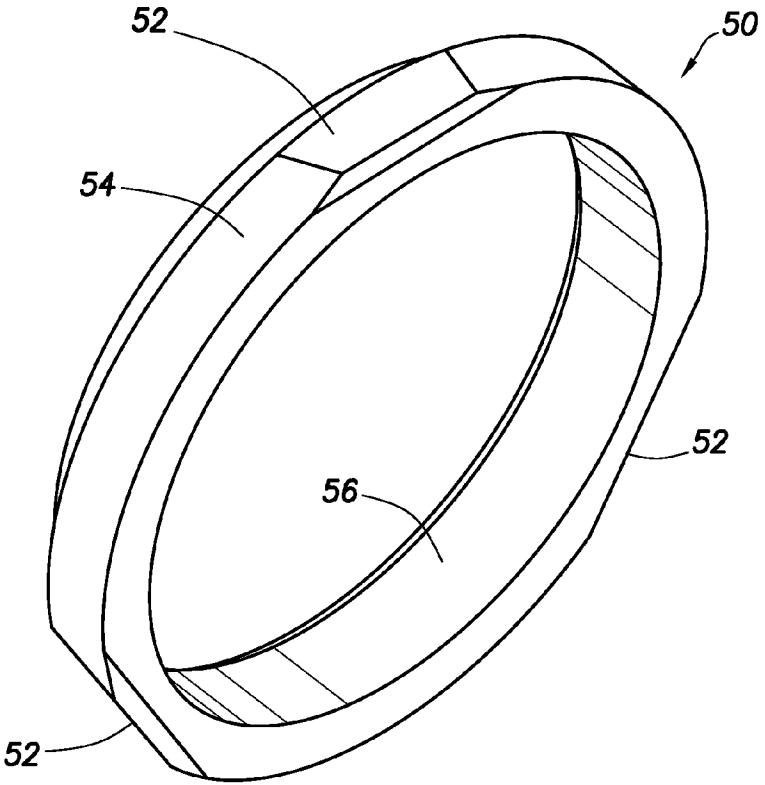

Referring additionally now to FIGS. 3A & B, representatively illustrated is an improved packing element 50 which embodies principles of the present invention. The packing element 50 may be used in the packing element assembly 24 of the well tool 12 in the system 10, but it should also be understood that the packing element may be used in other assemblies, well tools and systems in keeping with the principles of the invention.

Unlike the packing elements 30, 32, 34 of the assembly 28 described above, the packing element 50 does not have a circumferentially uniform cross-section. Instead, the packing element 50 has surface variations 52 on an outer surface 54 which is otherwise circumferentially uniform.

As used herein, the terms "circumferential," "circumferentially" and similar terms are used to indicate a direction along a circumference. For example, movement in a circumferential direction would follow a circular path (along a particular circumference).

As depicted in FIGS. 3A & B, the surface variations 52 are in the form of flat areas on the otherwise cylindrical outer surface 54. Other shapes of the surface variations 52 could be used in keeping with the principles of the invention. For example, the surface variations 52 could be in the form of concave recesses. The surface variations 52 could be formed on the packing element 50 after it is molded, or the surface variations could be present on the packing element as it is formed.

Although three of the surface variations 52 evenly spaced apart by 120 degrees on the outer surface 54 are illustrated in FIGS. 3A & B, it should be understood that any number, spacing and positioning of the surface variations may be used in keeping with the principles of the invention. For example, two, four or any other number of surface variations could be formed on an inner surface 56 of the seal element 50, if desired.

Figure 4B:
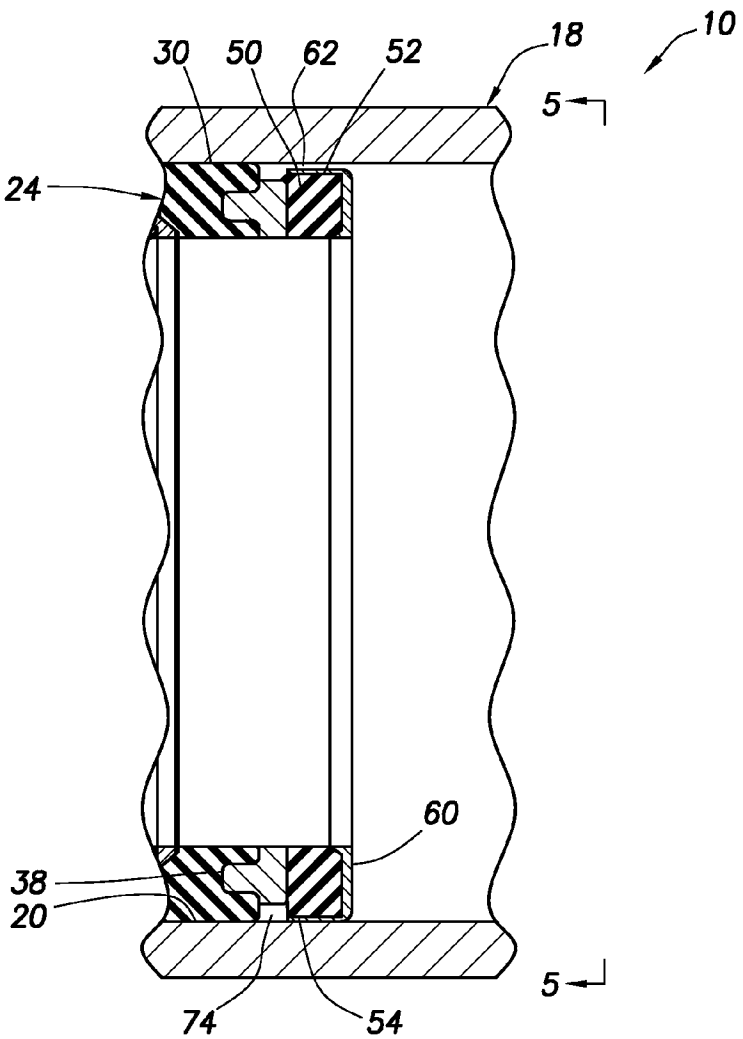
FIGS. 4A-C are schematic cross-sectional views of a packing element assembly embodying principles of the present invention and incorporating the packing element of FIGS. 3A & B, the assembly being unset in FIG. 4A, partially set in FIG. 4B, and more fully set in FIG. 4C.
Figure 4A:
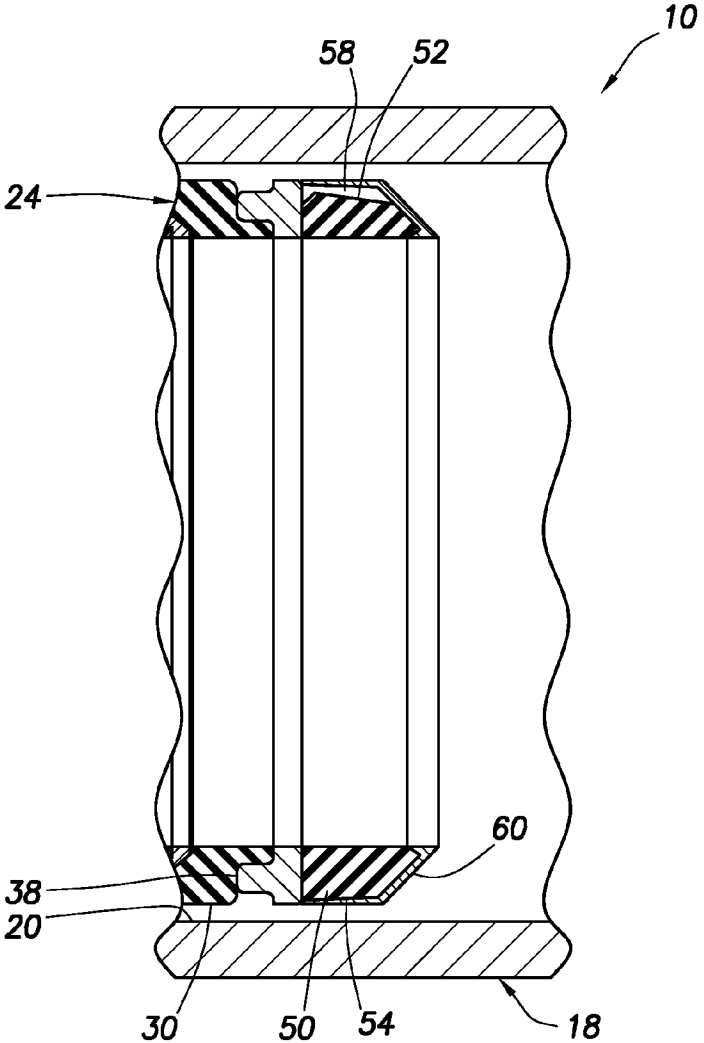
Figure 4C:
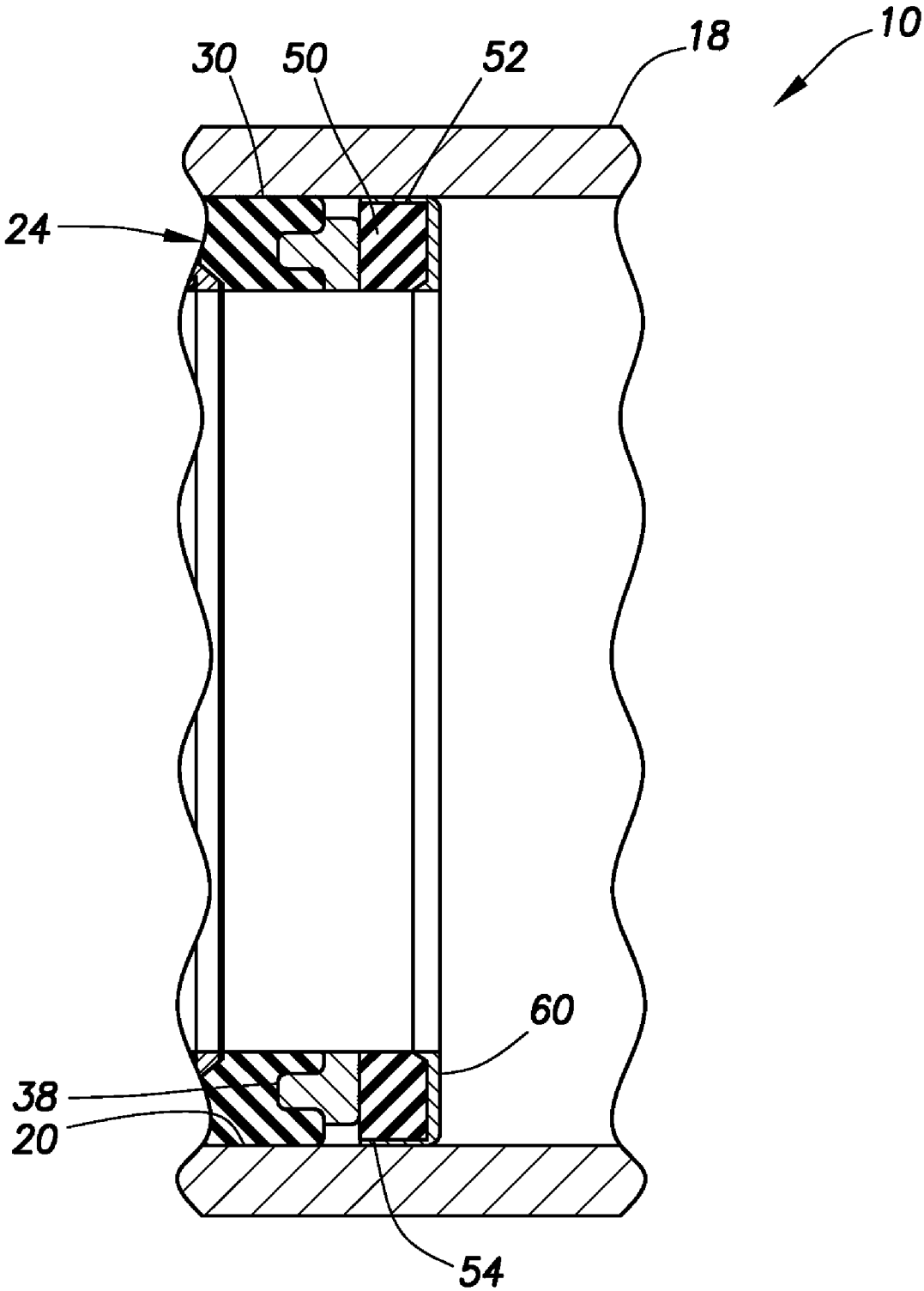

Referring additionally now to FIGS. 4A-C, the packing element 50 is representatively illustrated as a part of the packing element assembly 24 of the well tool 12 in the system 10. In this embodiment, the packing element 50 is used in place of each of the outer packing elements 32, 34 straddling the central packing element 30 and separators 36, 38.

In FIG. 4A, one end of the packing element assembly 24 is shown prior to being set in the tubular string 18, and in FIG. 4B, the assembly is shown after being set. For clarity of illustration, the inner tubular string 16 and the remainder of the well tool 12 are not shown in FIGS. 4A & B.

In FIG. 4A, it may be clearly seen that the cross-section of the packing element 50 is not circumferentially uniform.

Instead, at an upper portion of the drawing a gap 58 is visible between the packing element 50 and a backup ring 60. This gap 58 is not present between the packing element 50 and the backup ring 60 in a lower portion of the drawing.

It may now be appreciated that the packing element 50 will bias the backup ring 60 to deform radially outward by different amounts at different circumferential positions about the packing element. In particular, when the packing element 50 expands radially outward, the gap 58 will cause there to be less deformation of the backup ring 60 opposite the surface variations 52 as compared to circumferential positions opposite other portions of the outer surface 54.

In FIG. 4B, it may be clearly seen that, although the gap 58 has been eliminated by radially outward expansion of the packing element 50 (e.g., as a result of longitudinal compression of the packing element assembly 24), the backup ring 60 does not contact the inner surface 20 of the tubular string 18 opposite the surface variations 52 (as depicted at the top of FIG. 4B). However, opposite other circumferential portions of the outer surface 54 of the packing element 50, the backup ring 60 does contact the inner surface 20 of the tubular string 18 (as depicted at the bottom of FIG. 4B).

In this manner, the portions of the backup ring 60 which do not contact the inner surface 20 of the tubular string 18 provide paths for fluid to escape from the packing element assembly 24 as it expands radially outward. This lack of contact at gaps 62 between the backup ring 60 and the inner surface 20 is due to the surface variations 52 which cause the packing element 50 to bias the backup ring radially outward less in those circumferential positions opposite the surface variations.

In FIG. 4C, the well tool 10 has been fully set and, as a result, the packing element assembly 24 has been further radially outwardly extended, so that the gaps 62 are now closed off. Preferably, the gaps 62 are closed off after fluid has been displaced from the annular space 14 between the assembly 24 and the surface 20. In this manner, the fluid is squeezed from between the packing elements 30, 50, and from an annular volume 74 bounded partially by the separators 36, 38 between the packing elements, prior to closing off the gaps 62.

In a preferred sequence of setting the well tool 10, the central packing element 30 contacts the surface 20, then the fluid is squeezed from between the packing elements 30, 50 and from the volume 74 via the gaps 62, the packing elements 50 sealingly engage the surface 20, and then the gaps are closed off.

However, it should be understood that it is not necessary for the gaps 62 to be completely closed off when the well tool 10 is fully set. Instead, some portion of the gaps 62 could remain, but preferably these would be sufficiently small in dimension to prevent undesirable extrusion of the packing elements 30, 50 through the gaps.

Figure 5:
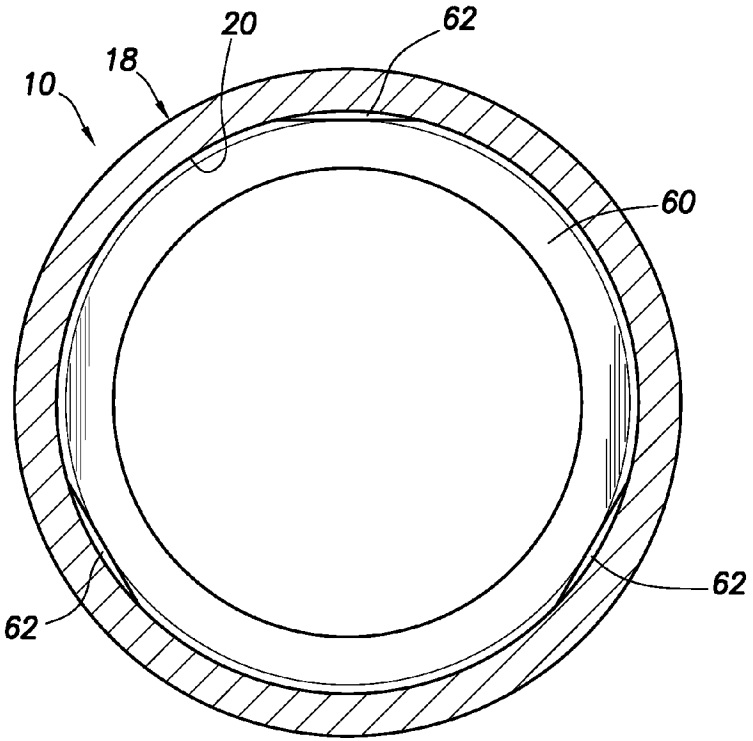
FIG. 5 is an enlarged scale end view of the set packing element assembly of FIG. 4B.

An end view of the set packing element assembly 24 is representatively illustrated in FIG. 5. In this view, the circumferential positioning of the gaps 62 between the backup ring 60 and the inner surface 20 of the outer tubular string 18 may be clearly seen. As discussed above, a larger or smaller number of variations 52 may be used, and different circumferential positions of the variations may be used, in keeping with the principles of the invention.

Figure 6:
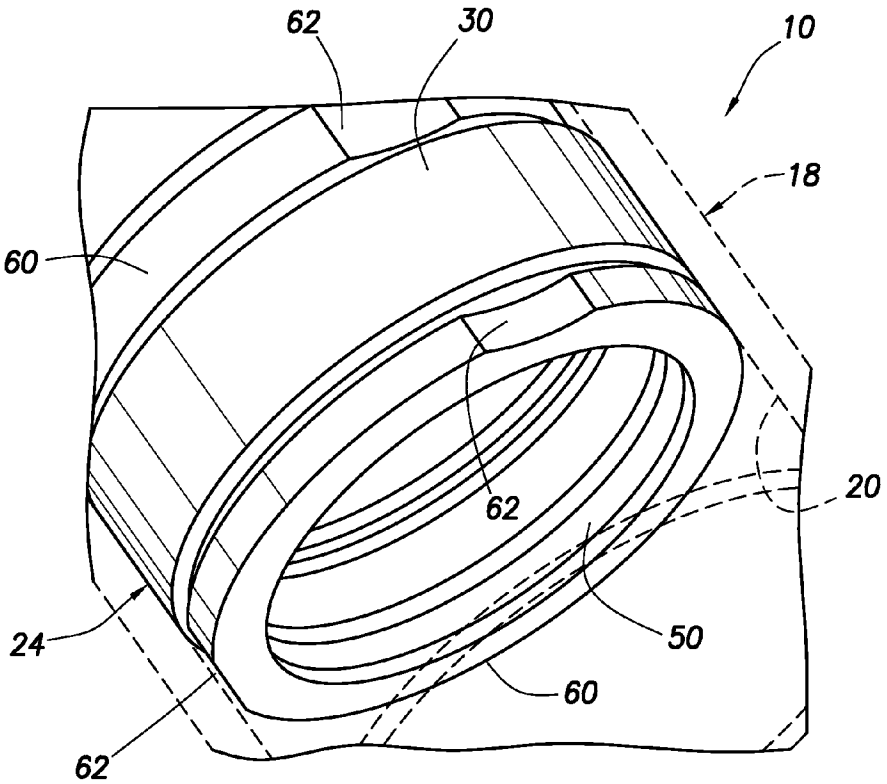
FIG. 6 is an isometric view of the set packing element assembly of FIG. 4B.

An isometric view of the set packing element assembly 24 is representatively illustrated in FIG. 6. In this view, the shape of the gaps 62 which result from the surface variations 52 on the outer surface 54 of the packing element 50 may be clearly seen. As discussed above, other shapes of the variations 52 may be used, to thereby produce different shapes of the gaps 62 as a result of the different biasing of the backup ring 60 opposite the variations, in keeping with the principles of the invention.

Note that FIGS. 4B, 5 & 6 do not necessarily depict the packing element assembly 24 in its fully set configuration. For example, the packing element assembly 24 may be only partially set as illustrated in these drawings.

In the embodiment depicted in FIG. 4C, the packing element assembly 24 could be further set, so that the gaps 62 are closed off after substantially all of the fluid has escaped from the annulus 14 between the packing element assembly and the inner surface 20 of the tubular string 18. In this embodiment, the gaps 62 could be closed off after the central packing element 30 has contacted and sealingly engaged the inner surface 20.

Thus, the variations 52 could be sized, positioned, configured, etc., so that the backup ring 60 is biased into contact with the inner surface 20 at a later time at circumferential positions radially opposite the variations, as compared to other circumferential positions about the backup ring. This later closing of the gaps 62 will provide for fluid escape, while also preventing extrusion of the packing elements 30, 50 through the gaps after the assembly 24 is fully set.

Figure 7:
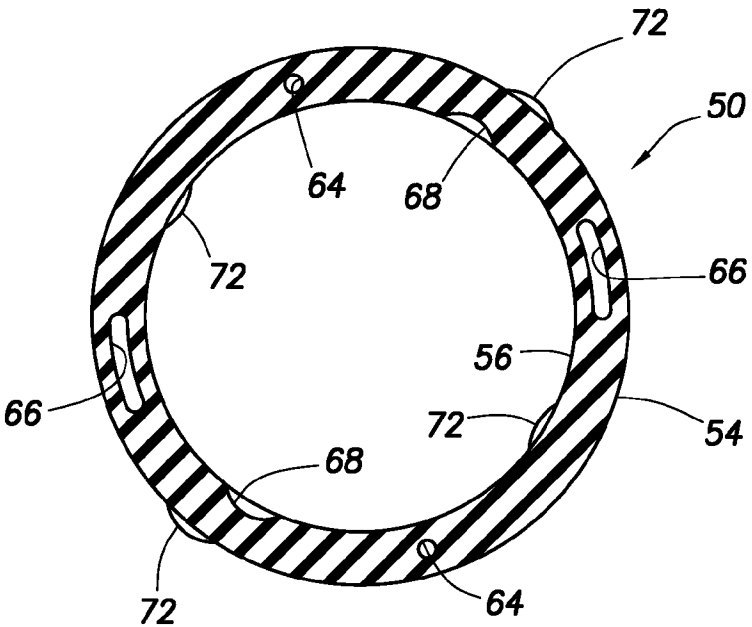

Referring additionally now to FIG. 7, an alternate configuration of the packing element 50 is representatively illustrated. In this alternate configuration of the packing element 50, other types of circumferential variations 64, 66, 68, 72 are used which alter the manner in which the packing element biases the backup ring 60 radially outward.

The variations 64 are holes formed in the packing element 50 between its inner and outer surfaces 54, 56. Thus, it will be appreciated that it is not necessary for a circumferential variation to be formed only on the outer surface 54 of the packing element 50.

The variations 66 are circumferentially extending slots formed in the packing element 50 between its inner and outer surfaces 54, 56. The variations 64, 66 could be closed off when the packing element 50 is expanded, so that the variations do not provide a leak path for fluid after the packing element assembly 24 is fully set.

The variations 68 are concave recesses formed on the inner surface 56 of the packing element 50. The variations 68 could be particularly useful in situations in which the packing element assembly 24 is expanded radially inward, instead of radially outward.

The variations 72 are convex protrusions formed on the inner surface 56 and/or outer surface 54 of the packing element 50. These variations 72 may cause portions of the backup ring 60 opposite the variations to contact the surface 20 prior to other circumferentially spaced apart portions of the backup ring contacting the surface.

Figure 8:
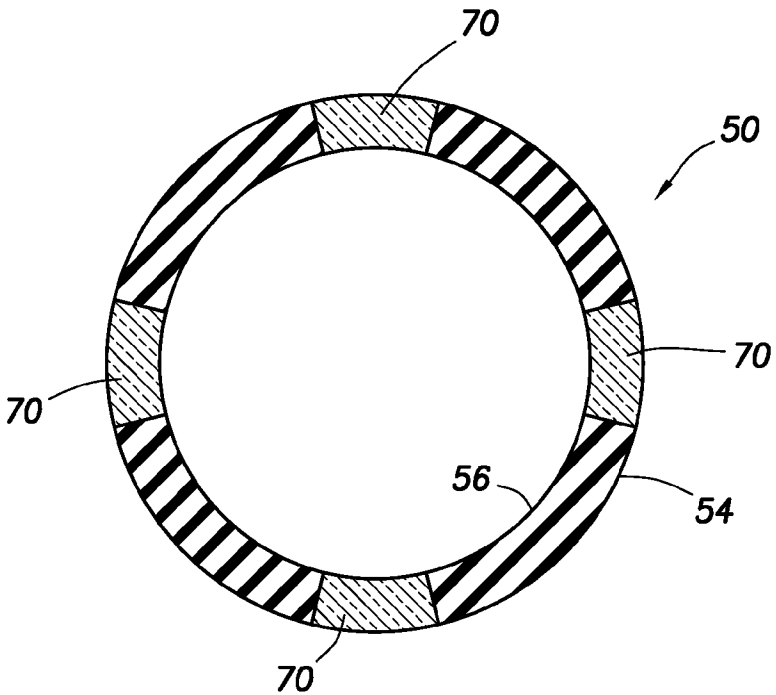
FIGS. 7 & 8 are end views of alternate configurations of the packing element of FIGS. 3A & B.

Referring additionally now to FIG. 8, another alternate configuration of the packing element 50 is representatively illustrated. In this alternate configuration of the packing element 50, circumferential variations 70 do not result from a lack of material (as with the variations 52, 64, 66, 68 described above). Instead, the variations 70 result from a difference in material properties.

For example, the variations 70 could have a varied modulus of elasticity or hardness as compared to the remainder of the packing element 50. Any difference in material properties may be used for the variations 70 in keeping with the principles of the invention.

The difference in material properties of the variations 70 causes the backup ring 60 to be biased differently at corresponding different circumferential positions about the packing element 50. In this manner, fluid is allowed to escape from the annulus 14 between the packing element assembly 24 and the inner surface 20, but no voids are left in the packing element 50 for a leak path after the packing element assembly is fully set.

Note that it is not necessary or even preferred in most circumstances for the circumferential variation(s) in the packing element 50 to be in any manner abrupt. For example, in the embodiment of FIG. 8, the variations 70 may result from gradual changes in material properties of the packing element. In the embodiments of FIGS. 3A & B and FIG. 7, the variations 52, 68, 72 are gradual in form. In this manner, stress concentrations in the packing element 50 and backup ring 60 are minimized or eliminated, and the biasing forces applied to the backup ring are gradually varied about the circumference of the backup ring.

It may now be fully appreciated that many beneficial features are provided by the various configurations of the packing element assembly 24 and its packing element 50 described above. These configurations allow otherwise trapped fluid to escape from between the components of the assembly 24 (e.g., from between the packing element 50 and the backup ring 60, from between the central packing element 30 and the outer elements, from a volume 74 bounded by the separator 38 between the packing elements, etc.). These configurations also do not introduce undesirable stress concentrations in the backup rings 60 (e.g., due to slots or holes in the backup rings as in prior designs).

The configurations of the packing element 50 described above include circumferential variations 52, 64, 66, 68, 70, 72 on its inner and outer surfaces 54, 56, and between the inner and outer surfaces. Any combination and number of the variations 52, 64, 66, 68, 70, 72 may be used in a single packing element 50 in keeping with the principles of the invention.

The packing element assembly 24 described above can eliminate the necessity of increased pressures and/or long duration setting times to permit escape of trapped fluid. In addition, the packing element assembly 24 may be particularly useful where relatively large expansion of the packing elements 30, 50 is desired.

One advance in the art provided by the packing element assembly 24 is that the shape of the backup ring 60 can be controlled during the setting operation by the packing element 50. In particular, the distribution of biasing forces/pressures exerted by the packing element 50 on the backup ring 60 can be varied circumferentially about the packing element by providing corresponding circumferential variations in the packing element.

The interaction between the packing element 50 and the backup ring 60 can be staged and otherwise controlled to influence the setting operation in a progressive manner. For example, the gaps 62 can be formed to allow escape of fluid, and then the gaps can be closed to prevent extrusion of packing elements.

The configurations of the packing element 50 can also be useful to enhance the performance of the central packing element 30 and the overall packing element assembly 24. For example, by preventing excess fluid from being trapped in the packing element assembly 24 during the setting operation, greater elastic compression force can be stored in the assembly after setting, thereby increasing the pressure holding capability of the assembly. In addition, the elastic compression force can be more evenly distributed throughout the assembly 24.

This increase in the elastic compression force, and its more even distribution in the assembly 24, permit greater flexibility in selecting the materials and material properties for the packing elements 30, 50. For example, materials having greater hardness may be used in packing element assemblies designed for relatively high temperature and/or high pressure environments.

As described above, the well tool 12 constructed in accordance with the principles of the invention may include the packing element assembly 24 for sealingly engaging the surface 20. The assembly 24 may include the packing element 50 having one or more circumferential variations 52, 64, 66, 68, 70.

The variations 52, 64, 66, 68 are formed as a lack of material in a cross-section of the packing element 50. As clearly depicted in at least FIGS. 3A, 3B and 7, a plane of the cross-section is orthogonal to a central axis of the packing element 50. The variations 72 are formed as protrusions on inner and/or outer surfaces 54, 56 of the packing element 50. The variations 70 comprise a difference in at least one material property as compared to other circumferential portions of the packing element 50.

The variations 64, 66 are voids formed between inner and outer surfaces 54, 56 of the packing element 50. The variations 52, 68 are recesses formed on the inner and outer surfaces 54, 56 of the packing element. The packing element 50 may include multiple variations 52, 64, 66, 68, 70 circumferentially distributed about the packing element.

The packing element 50 may apply a different biasing force to the backup ring 60 at the variations 52, 64, 66, 68, as compared to a biasing force applied by the packing element to the backup ring at other portions of the packing element circumferentially spaced apart from the variations.

The packing element 50 may bias the backup ring 60 into contact with the surface 20 at portions of the packing element circumferentially spaced apart from the variations 52, 64, 66, 68, without biasing the backup ring into contact with the surface at the variation. This lack of contact may provide the gaps 62 for escape of otherwise trapped fluid.

The packing element 50 may bias the backup ring 60 into contact with the surface 20 at portions of the packing element circumferentially spaced apart from the variations 52, 64, 66, 68 prior to biasing the backup ring into contact with the surface at the variation. In this manner, the gaps 62 may be closed when the assembly 24 is fully set.

The packing element assembly 24 may include the backup ring 60 which initially has a circumferentially uniform cross-section. The packing element may deform the backup ring so that it has a circumferentially non-uniform cross-section when the assembly is being set.

The well tool 12 may be provided with the packing element assembly 24 including the packing element 50 and the backup ring 60. The packing element 50 may be configured to bias the backup ring 60 into contact with the surface 20 opposite one circumferential portion of the backup ring, while another circumferential portion of the backup ring does not contact the surface.

The second circumferential portion of the backup ring 60 may contact the surface 20 after the first circumferential portion of the backup ring contacts the surface. The packing element 50 may have one or more circumferential variations 52, 64, 66, 68, 70 opposite the second circumferential portion (s) of the backup ring 60.

Also described above is a method of setting the well tool 12 with the packing element assembly 24. The method may include the steps of: providing the packing element assembly 24 with the packing element 50 having one or more circumferential variations 52, 64, 66, 68, 70; and setting the well tool 12. In the setting step, the packing element 50 may apply a biasing force to displace a portion (e.g., the backup ring 60) of the packing element assembly 24 into contact with the surface 20. The biasing force may be different at the variations 52, 64, 66, 68, 70 as compared to at portions of the packing element 50 circumferentially spaced apart from the variations.

The portion of the packing element assembly 24 may be deformed by the packing element 50 differently at the variations 52, 64, 66, 68, 70 as compared to at the portions of the packing element circumferentially spaced apart from the variations.

The portion of the packing element assembly 24 may be the backup ring 60 having a circumferentially uniform initial cross-section. In the setting step, the packing element 50 may deform the backup ring 60 so that it has a circumferentially non-uniform cross-section.

Another method described above includes the steps of: providing the packing element assembly 24 with multiple packing elements 30, 50; and setting the well tool 10, the setting step including squeezing fluid from between the packing elements via at least one gap 62, and then closing off the gap.

The packing element assembly 24 may include at least one separator 36, 38 between the packing elements 30, 50, and the squeezing step may include squeezing the fluid from the volume 74 (see FIG. 4B) bounded at least partially by the separator.

The gap 62 may be formed radially between the packing element assembly 24 and the surface 20 against which the packing element assembly seals in the setting step. The step of closing off the gap 62 may include sealing the packing element assembly 24 against the surface 20 at the gap.

The gap 62 may be formed between the backup ring 60 and the surface 20 against which the packing element assembly 24 seals in the setting step. The circumferential variation(s) 52, 64, 66, 68, 70 and/or 72 in at least one of the packing elements 30, 50 may result in a circumferentially varying biasing force being applied to the backup ring 60 to thereby form the gap 62 during the setting step.

The gap 62 may be formed by radially extending a portion of the packing element assembly 24 into contact with the surface 20 while another portion of the packing element assembly does not contact the surface, with the first portion being circumferentially offset relative to the second portion.

The packing elements may include the central packing element 30 and at least two outer packing elements 50 straddling the central packing element. The squeezing step may include squeezing the fluid from between the central packing element 30 and each of the outer packing elements 50 prior to closing off the gap 62.

The method may include the step of forming multiple gaps 62 circumferentially distributed about the packing element assembly 24. The setting step may include closing off each of the multiple gaps 62.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A well tool, comprising:

a packing element assembly for sealingly engaging a surface, the assembly including a backup ring and a packing element having at least one variation in a cross-sectional plane orthogonal to its central axis, and wherein the variation applies circumferentially varying radial biasing forces to the backup ring.

2. The well tool of claim 1, wherein the variation comprises a lack of material in a cross-section of the packing element.

3. The well tool of claim 1, wherein the variation comprises a protrusion formed on a surface of the packing element.

4. The well tool of claim 1, wherein the variation comprises a difference in at least one material property between respective different circumferential portions of the packing element.

5. The well tool of claim 1, wherein the packing element biases the backup ring into contact with the surface at portions of the packing element circumferentially spaced apart from the variation, without biasing the backup ring into contact with the surface at the variation.

6. The well tool of claim 1, wherein the packing element biases a backup ring into contact with the surface at portions of the packing element circumferentially spaced apart from the variation prior to biasing the backup ring into contact with the surface at the variation.

7. The well tool of claim 1, wherein the variation comprises a void formed between inner and outer surfaces of the packing element.

8. The well tool of claim 1, wherein the variation comprises a recess formed on a surface of the packing element.

9. The well tool of claim 1, wherein the packing element includes multiple variations circumferentially distributed about the packing element.

10. The well tool of claim 1, wherein the backup ring has a circumferentially uniform initial cross-section, and wherein the packing element deforms the backup ring so that it has a circumferentially non-uniform cross-section when the assembly is being set.

11. A well tool, comprising:

a packing element assembly including a packing element and a backup ring, the packing element being configured to bias the backup ring into contact with a surface opposite at least one first circumferential portion of a circumference of the backup ring, while at least one second circumferential portion of the circumference of the backup ring does not contact the surface.

12. The well tool of claim 11, wherein the second circumferential portion of the backup ring contacts the surface after the first circumferential portion of the backup ring contacts the surface.

13. The well tool of claim 11, wherein the packing element has at least one circumferential variation opposite the second circumferential portion of the backup ring.

14. The well tool of claim 13, wherein the variation comprises a lack of material in a cross-section of the packing element.

15. The well tool of claim 13, wherein the variation comprises a protrusion on a surface of the packing element.

16. The well tool of claim 13, wherein the variation comprises a difference in at least one material property as compared to other circumferential portions of the packing element.

17. The well tool of claim 13, wherein the packing element applies a different biasing force to the backup ring at the variation, as compared to a biasing force applied by the packing element to the backup ring at other portions of the packing element circumferentially spaced apart from the variation.

18. The well tool of claim 13, wherein the variation comprises a void formed between inner and outer surfaces of the packing element.

19. The well tool of claim 13, wherein the variation comprises a recess formed on a surface of the packing element.

20. The well tool of claim 13, wherein the packing element includes multiple variations circumferentially distributed about the packing element.

21. The well tool of claim 11, wherein the backup ring has a circumferentially uniform cross-section initially, and wherein the packing element deforms the backup ring so that it has a circumferentially non-uniform cross-section when the assembly is being set.

22. A method of setting a well tool including a packing element assembly, the method comprising the steps of:

providing the packing element assembly with a backup ring and a packing element having at least one variation in a cross-sectional plane orthogonal to its central axis; and setting the well tool, the packing element applying a biasing force to displace the backup ring into contact with a surface, and the biasing force being different at the variation as compared to at portions of the packing element circumferentially spaced apart from the variation.

23. The method of claim 22, wherein the backup ring is formed by the packing element differently at the variation as compared to at the portions of the packing element circumferentially spaced apart from the variation.

24. The method of claim 22, wherein in the providing step, the variation comprises a lack of material in a cross-section of the packing element.

25. The method of claim 22, wherein in the providing step, the variation comprises a protrusion formed on a surface of the packing element.

26. The method of claim 22, wherein in the providing step, the variation comprises a difference in at least one material property as compared to the portions of the packing element circumferentially spaced apart from the variation.

27. The method of claim 22, wherein the packing element biases the backup ring into contact with the surface at the portions of the packing element circumferentially spaced apart from the variation, without biasing the portion of the assembly into contact with the surface at the variation.

28. The method of claim 22, wherein the packing element biases the backup ring into contact with the surface at the portions of the packing element circumferentially spaced apart from the variation, prior to biasing the backup ring into contact with the surface at the variation.

29. The method of claim 22, wherein the variation comprises a void formed between inner and outer surfaces of the packing element.

30. The method of claim 22, wherein the variation comprises a recess formed on a surface of the packing element.

31. The method of claim 22, wherein the packing element includes multiple variations circumferentially distributed about the packing element.

32. The method of claim 22, wherein the backup ring has a circumferentially uniform initial cross-section, and wherein the packing element deforms the backup ring so that it has a circumferentially non-uniform cross-section in the setting step.

* * * * *

UNITED STATES PATENT AND TRADEMARK OFFICE

CERTIFICATE OF CORRECTION

PATENT NO. : 7,926,581 B2
APPLICATION NO. : 12/047163
DATED : April 19, 2011
INVENTOR(S) : Gregory S. Marshall et al.

It is certified that error appears in the above-identified patent and that said Letters Patent is hereby corrected as shown below:

Column 10, line 16, cancel the text beginning with "6. A well tool of claim 1," to and ending "at the variation." in column 10, line 20, and insert the following claim:

--6. The well tool of claim 1, wherein the packing element biases the backup ring into contact with the surface at portions of the packing element circumferentially spaced apart from the variation prior to biasing the backup ring into contact with the surface at the variation.--

Column 12, line 5, cancel the text beginning with "27. The method of claim 22," to and ending "at the variation." in column 12, line 9, and insert the following claim:

--27. The method of claim 22, wherein the packing element biases the backup ring into contact with the surface at the portions of the packing element circumferentially spaced apart from the variation, without biasing the backup ring into contact with the surface at the variation.--

Signed and Sealed this
Sixth Day of December, 2011

David J. Kappos

David J. Kappos
*Director of the United States Patent and Trademark Office*